US006584993B1

(12) United States Patent
Chang

(10) Patent No.: US 6,584,993 B1
(45) Date of Patent: Jul. 1, 2003

(54) PORTABLE-TYPE CLEANING DEVICE FOR INTERNAL COMBUSTION ENGINE

(76) Inventor: Yen-Hsi Chang, PO Box 82-144, Taipei (TW)

( * ) Notice: Subject to any disclaimer, the term of this patent is extended or adjusted under 35 U.S.C. 154(b) by 164 days.

(21) Appl. No.: 09/706,381

(22) Filed: Nov. 6, 2000

(51) Int. Cl.[7] ..... B08B 3/02

(52) U.S. Cl. ..... 134/169 A; 134/100.1; 134/102.1; 134/169 C; 123/198 A

(58) Field of Search ..... 134/94.1, 100.1, 134/102.1, 169 A, 169 C, 166 C; 123/198 A

(56) References Cited

U.S. PATENT DOCUMENTS 1,395,571 A * 11/1921 Howard
1,585,025 A * 5/1926 Gorschalki et al.
RE16,425 E * 9/1926 Bird
1,603,984 A * 10/1926 Rose et al.
1,685,598 A * 9/1928 Davis
1,772,011 A * 8/1930 Malo
1,924,704 A * 8/1933 Bartholomew
2,079,676 A * 5/1937 Carson
3,175,546 A * 3/1965 Roper
3,557,763 A * 1/1971 Probst
3,875,922 A * 4/1975 Kirmss
4,076,002 A * 2/1978 Mellqvist et al.
4,374,507 A * 2/1983 Protacio et al.
4,703,728 A * 11/1987 Payne et al.
4,791,890 A * 12/1988 Miles et al.
5,022,364 A * 6/1991 Phillips
5,257,604 A * 11/1993 Vataru et al.
5,353,761 A * 10/1994 Kalishman
5,516,370 A * 5/1996 Karnauchow et al.
5,970,994 A * 10/1999 Saski et al.
6,178,977 B1 * 1/2001 Wells

* cited by examiner

*Primary Examiner*—Frankie L. Stinson
(74) *Attorney, Agent, or Firm*—Leong C. Lei

(57) ABSTRACT

A portable-type cleaning device for internal combustion engine comprising a container containing a cleaning solution and a guiding tube connected to the container and the internal combustion engine, and an opening being provided at the top end of the container for the insertion of the guiding tube, wherein, the middle section of the guiding tube is provided with a pressurizing hole for the entry of air, and the height of the pressurizing hole is at least higher than that of the level of the cleaning solution within the container. The other end of the guiding tube is directly inserted into the air-inlet tube of the internal combustion engine. The vacuum suction created by igniting the internal combustion engine drives the cleaning solution and air to enter respectively through the bottom end and the pressurizing hole of the tube. At the same time, the air and the cleaning solution are mixed forming into bubbles or atomized, entering the internal combustion engine. Thus the accumulated carbon in the internal combustion engine and the pipes thereof are cleaned away.

8 Claims, 6 Drawing Sheets

PORTABLE-TYPE CLEANING DEVICE FOR INTERNAL COMBUSTION ENGINE

BACKGROUND OF THE INVENTION (a) Technical Field of the Invention

The present invention relates to a portable-type-cleaning device for internal combustion engine, and in particular, a cleaning device without using an air compressor to directly clean away carbon accumulated in the internal combustion engine and the conduits thereof of a vehicle.

(b) Description of the Prior Art

Internal Combustion Engine employs fuel and air to mix within a cylinder to provide ignition and cracking so as to reciprocate pistons of the engine. After a long period of operation of the engine, the inlet-manifold tubes and the combustion chamber of the engine will accumulate with carbon. If the accumulation of carbon reaches a carbon level, the efficiency operation of the engine will be affected and the combustion of fuel may not be smooth. In a worse situation, the longevity of the Internal Combustion Engine will be shortened. Thus, the Internal Combustion Engine should be maintained and cleaned periodically so as to maintain normal operation and ignition of the engine.

FIG. 1 is a conventional cleaning device for internal combustion engine. The device comprises a liquid storage tank 10 having a top end connected to an air-inlet tube 11 of an air compressor. Another top end of the liquid storage tank 10 is provided with an external tube 12 inserted into the tank 10. The top section of the external tube 12 is provided with an air-guiding hole 13 and the bottom section of the external tube 12 is provided with a guiding tube 14 extended upward. The top end of the external tube 12 is provided with an inner tube 15 inserted into the interior of the external tube 12. The guiding tube 14 can be inserted into the interior of the inner tube 15 and the top end of the inner tube is connected to an output tube 16 which is connected to the head of a spraying gun. When the operator presses the head of the spraying gun, air enters the air compressor and a high pressurized-air via the air-inlet tube 11 enters into the tank 10. Thus, the high pressurized-air produces a downward pressure to cause the cleaning solution to flow into the inner tube 15 from the guiding tube 14 of the external tube 12. The high pressurized-air and the cleaning solution are atomized (if the cleaning solution contains a foaming agent, bubbles are formed) and via the output tube 16 of the spraying gun 16 to the internal combustion engine to clean away the accumulated carbon in the internal combustion engine.

The above conventional device can achieve the cleaning objective, but there are drawbacks for the reason that a high pressure is used to force a cleaning solution in a tank to enter the internal combustion engine in either atomized solution or bubble forms of solution. In order to have high pressurized-air, an air compressor is required and the tank containing the cleaning solution is relatively large in size.

Accordingly the drawbacks are as follows:

(1) As the conventional cleaning device needs an air compressor, and this type of compressor is normally not portable and therefore, the cleaning process has to be done in a workshop and cannot be carried along.

(2) As the cleaning device is not portable and is mounted within a workshop, it is a waste of time to clean the internal combustion engine, and the cost of cleaning process is high. Besides, the user may have forgotten to go to the workshop for the maintenance of the engine, which subsequently may cause a serious damage to the engine.

(3) As the cleaning device is fixed and not portable, it requires a specialist to operate the device and therefore it does not provide the pleasure of DIY operation.

SUMMARY OF THE PRESENT INVENTION

Accordingly it is an object of the present invention to provide a portable-type-cleaning device for internal combustion engine which can be easy operated to clean away accumulated carbon in the internal combustion engine, and reduce the cost of treating process.

Yet another object of the present invention is to provide a portable-type cleaning device for internal combustion engine, characterized in that the external diameter of the guiding tube is smaller than the internal diameter of the opening of the container, and the middle section of the guiding tube is provided with a pressurizing hole for the entry of air, the height of the pressurizing hole is at least higher than that of the level of the cleaning solution within the container.

Another aspect of the present invention is to provide a portable-type cleaning device for internal combustion engine comprising a container containing a cleaning solution and a guiding tube connected to the container and the internal combustion engine, and an opening being provided at the tope end of the container, characterized in that interior of the opening is plugged with a plug having an expansion section at the center thereof, and the bottom of the expansion section is a suction tube extended to the container, and the top of the expansion section is connected to the guiding tube, and the plug, at the external circumferential edge of the expansion section, is provided with a plurality of communication holes so as to communicate with the interior and external sides of the container, and the internal of the expansion section is provided with a plurality of pressurizing holes which are in communication with the interior of the container.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
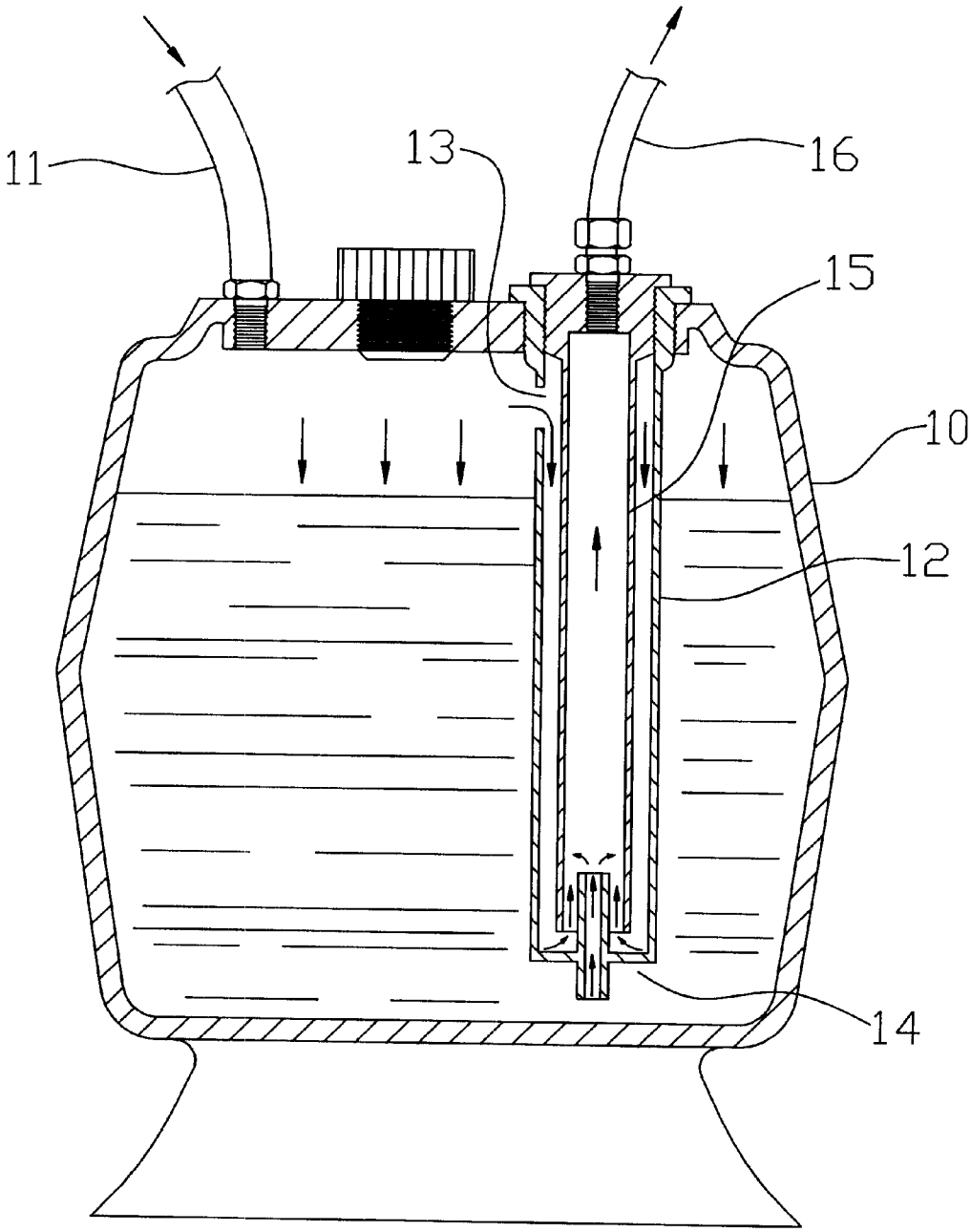
PRIOR ART FIG. 1
FIG. 1 is a schematic sectional view of a conventional cleaning device for internal combustion engine, showing the components of the liquid storage tank and the relative positions thereof.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
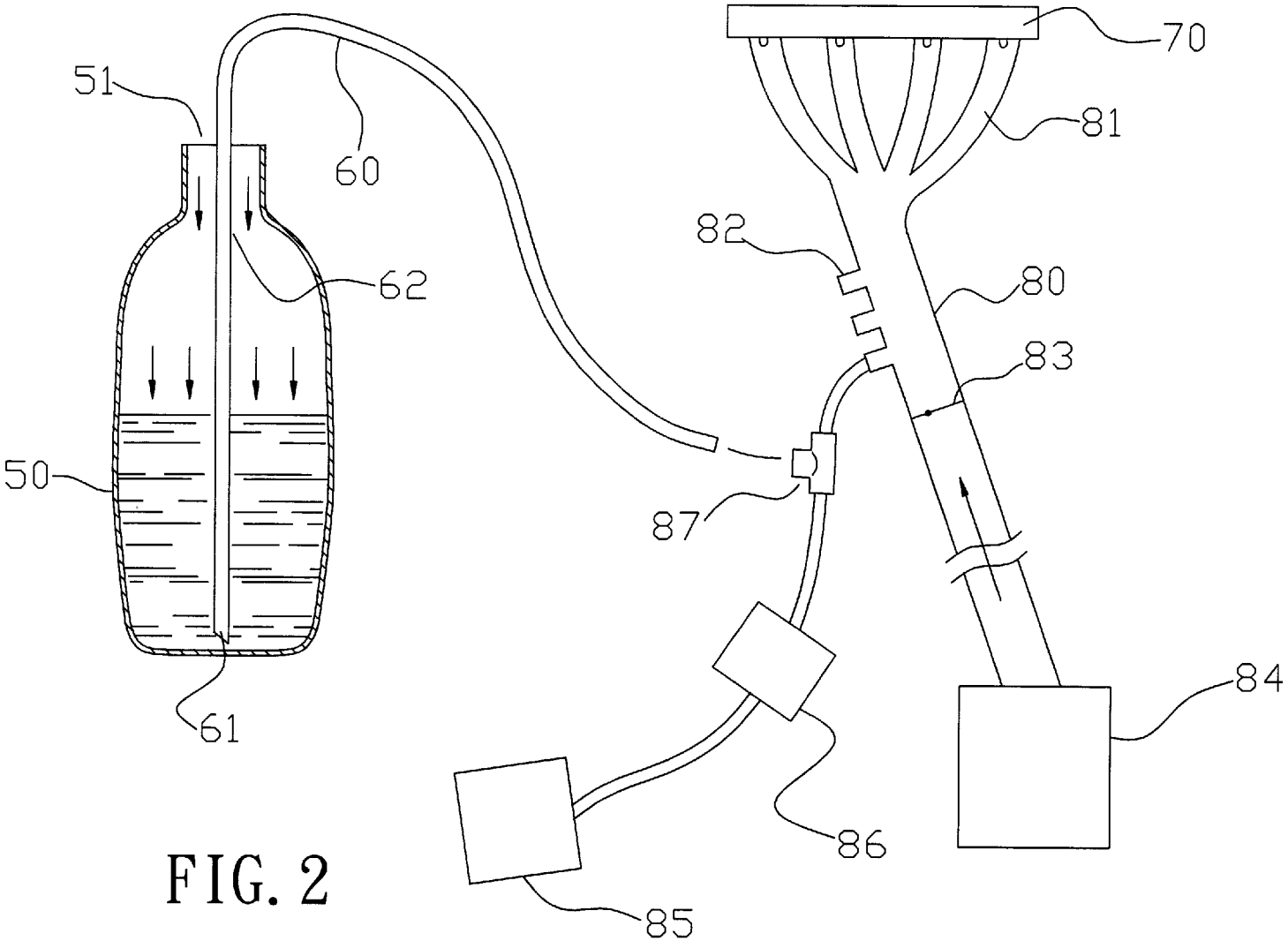
FIG. 2 is an elevation view of a portable-type-cleaning device for internal combustion engine, showing the components of the elements and their relative position, in accordance with the present invention.

The present invention relates to a cleaning device for internal combustion engine, which is portable and can be easily operated. As illustrated in FIG. 2, the cleaning device for internal combustion engine comprises a container 50 containing a cleaning solution, a guiding tube 60 connecting the container 50 and the internal combustion engine 70. An air-inlet tube 80 mounted with an air-inlet branched tube 81 is provided on the top of the internal combustion engine 70 and the air-inlet tube 80 is connected to an air-filtering device 84 so as to filter external air and to guide air to flow into the internal combustion engine 70. The middle section of the air-inlet tube 80 is an air-inlet valve 83 controlled by the ignition of the vehicle. The top of the air-inlet tube 80 is provided with a plurality of connectors 82, wherein one of the connectors 82 is serially connected to the fuel tank 85 and gasoline fume recycling device 86 so that when the vehicle is ignited the air-inlet valve 83 is opened and the vacuum caused by the internal combustion engine 70 will suck in air and fuel for the ignition and cracking of the engine to produce power.

Figure 3:
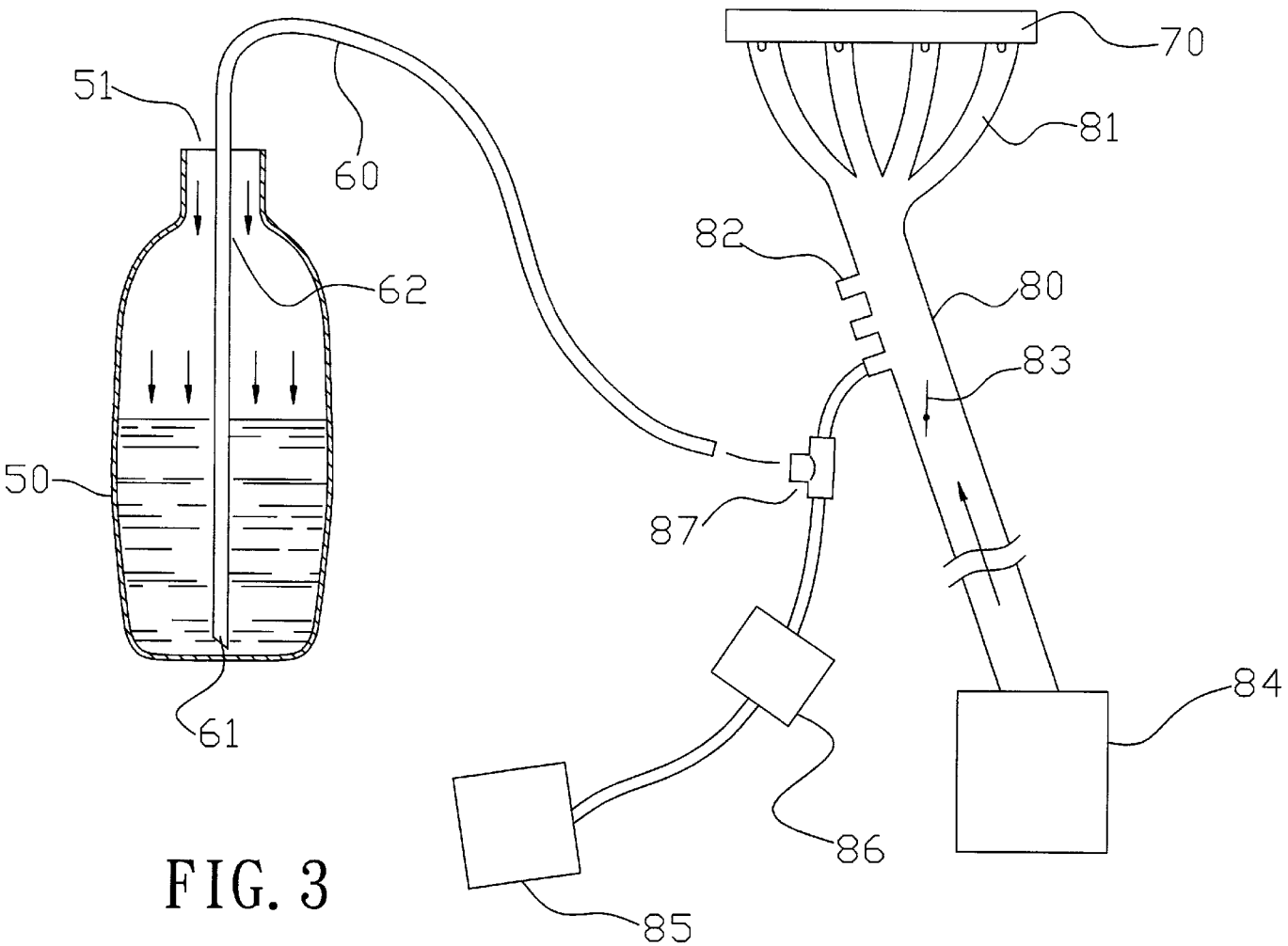
FIG. 3 is a schematic view showing the status of operation of the portable-type-cleaning device for internal combustion engine in accordance with the present invention.

Referring to FIGS. 2 and 3, the top end of the container 50 is provided with an opening 51 and the external diameter of the guiding tube 60 is smaller than the internal diameter of the opening 51 of the container 50. Air from the external can smoothly enter the container 50 and one end of the guiding tube being a sloping port is inserted into the container so as to keep the smooth flow of the cleaning solution via the guiding tube 60. The middle section of the guiding tube 60 is provided with a pressurizing hole 62 for the entry of air, and the height of the pressurizing hole 62 is at least higher than that of the level of the cleaning solution within the container 50. The tube connecting the connector 82 is provided with a manifold connector 87 for the connection of the free end of the guiding tube 60.

By employing the above device, a convenient and easy operation of cleaning the internal combustion engine can be achieved. As shown in FIG. 3, the user needs a container 50 with an opening 51 containing a cleaning solution (contained foaming agent) and inserts the guiding tube 60 with the sloping port 61 into the container 50, and the free end of the guiding tube 60 is connected to the manifold connector 87(or the guiding tube 60 is directly inserted to the air-inlet tube 80). Then, the engine of the vehicle is ignited such that the air-inlet valve 83 within the air-inlet tube 80 is opened. At this instance, the vacuum within the internal combustion engine 70 will suck in air and fuel. The cleaning solution within the container 50 is sucked be the vacuum and the air is forced in via the pressuring hole 62 of the guiding tube 60. Thus the cleaning solution and air are mixed and the cleaning solution is atomized or becomes bubbles entering the internal combustion engine 70 so as to clean away the accumulated carbon at the internal combustion engine 70 and the tube of the engine. In accordance with the present invention, no air compressor is needed and a common container, such as a PET bottle, can be used. Accordingly, the portable-type-cleaning device is simple in application.

Figure 4:
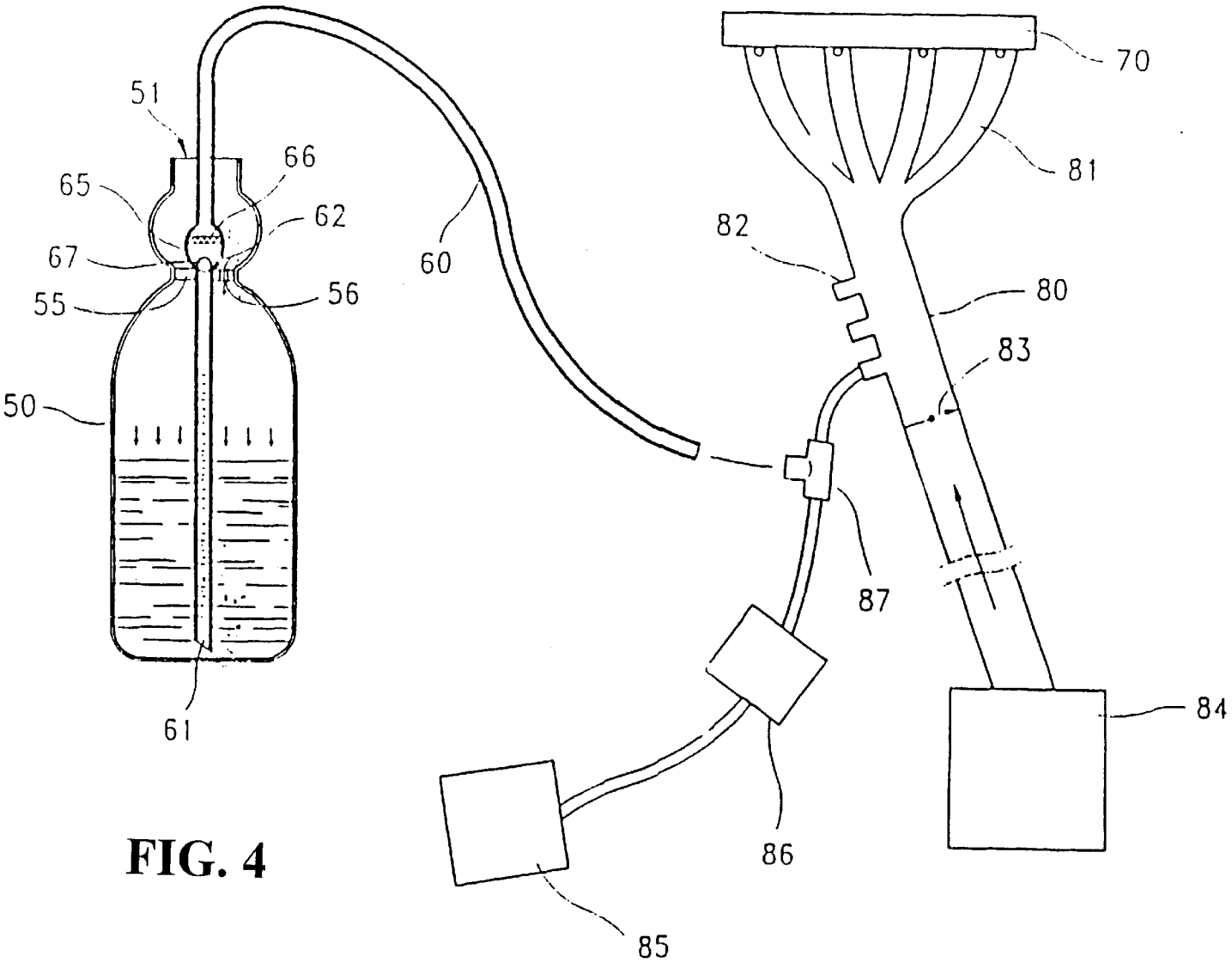
FIG. 4 is a schematic elevation view showing the status of operation of another preferred embodiment of the portable-type-cleaning device for internal combustion engine in accordance with the present invention.
Figure 5:
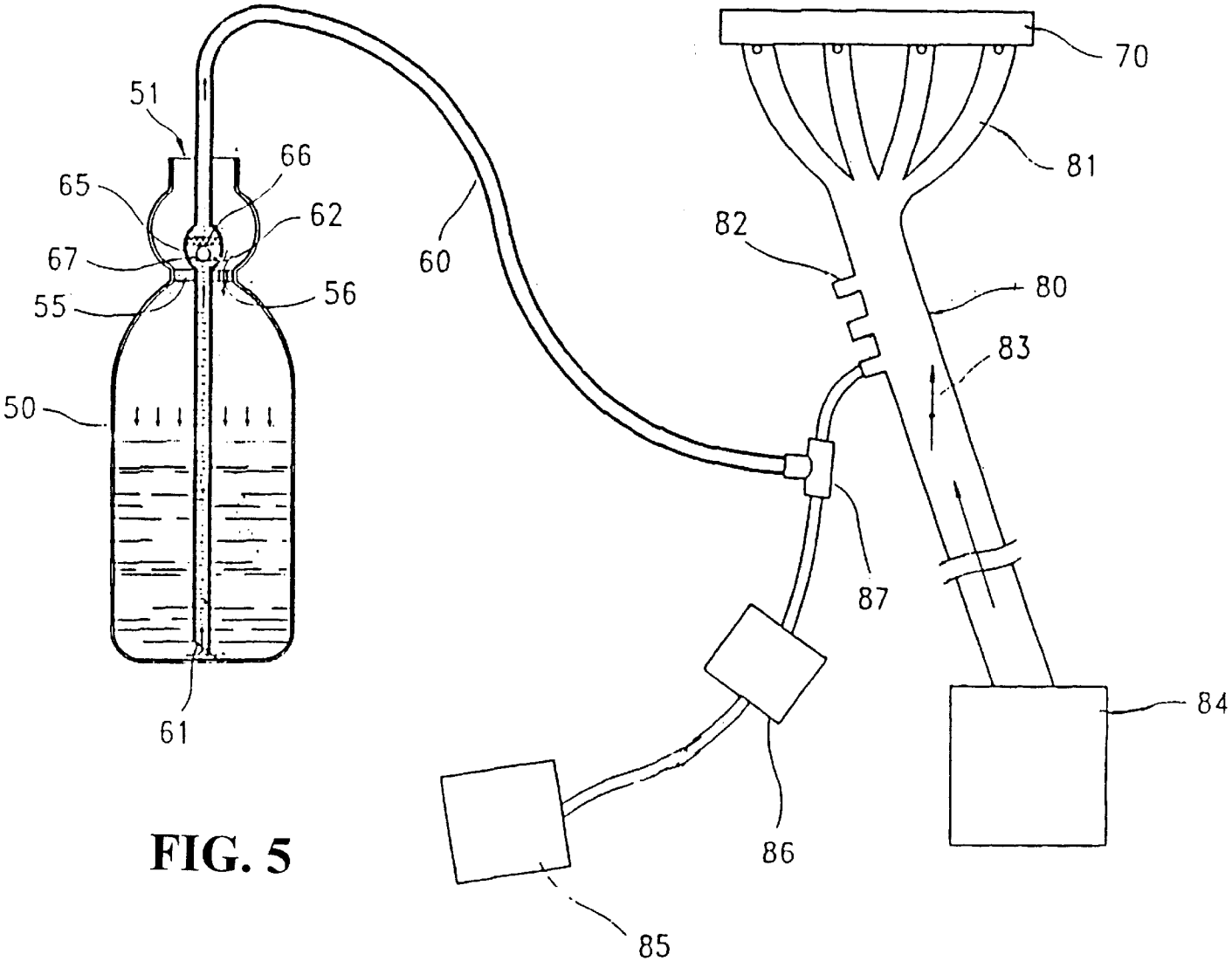
FIG. 5 is a schematic view showing the status of operation of another preferred embodiment of the portable-type-cleaning device for internal combustion engine in accordance with the present invention.

FIGS. 4 and 5 show another preferred embodiment of the present invention. A partitioning disc 55 is mounted at the opening 51 of the container 50 for the positioning of the guiding tube 60 so as to improve practicability. A plurality of pores 56 are formed on the partitioning disc 55 for the air to enter the container 50. The middle section of the guiding tube 60 is formed into an air-mixing chamber 65 having a larger space. A pressurizing hole 62 is formed at the circumferential edge of the air-mixing chamber 65. A foamed body 66 with very fine net-holes is mounted to the air-mixing chamber 65. The lower space of the foamed body 66 of the air-mixing chamber 65 is provided with an anti-reverse flow valve 67 and the reverse flow ball 67 has an external diameter larger than the internal diameter of the guiding tube 60. Such anti-reverse flow ball 67 provides a sealing effect.

The large air-mixing chamber 65 prolongs the mixing time of the cleaning solution and air such that the formation of bubble or atomization of the cleaning solution is effective. In addition, the fine net holed of the foamed body 66 cause the formation of bubbles to be very even. The anti-reverse flow ball 67 maintains the level of the cleaning solution within the guiding tube 60 by sealing the guiding tube 60 when the internal combustion engine 70 is temporarily switched off. Thus, when the user re-ignites the internal combustion engine 70 for cleaning, the speed of cleaning solution entering the internal combustion engine 70 is increased.

Figure 6:
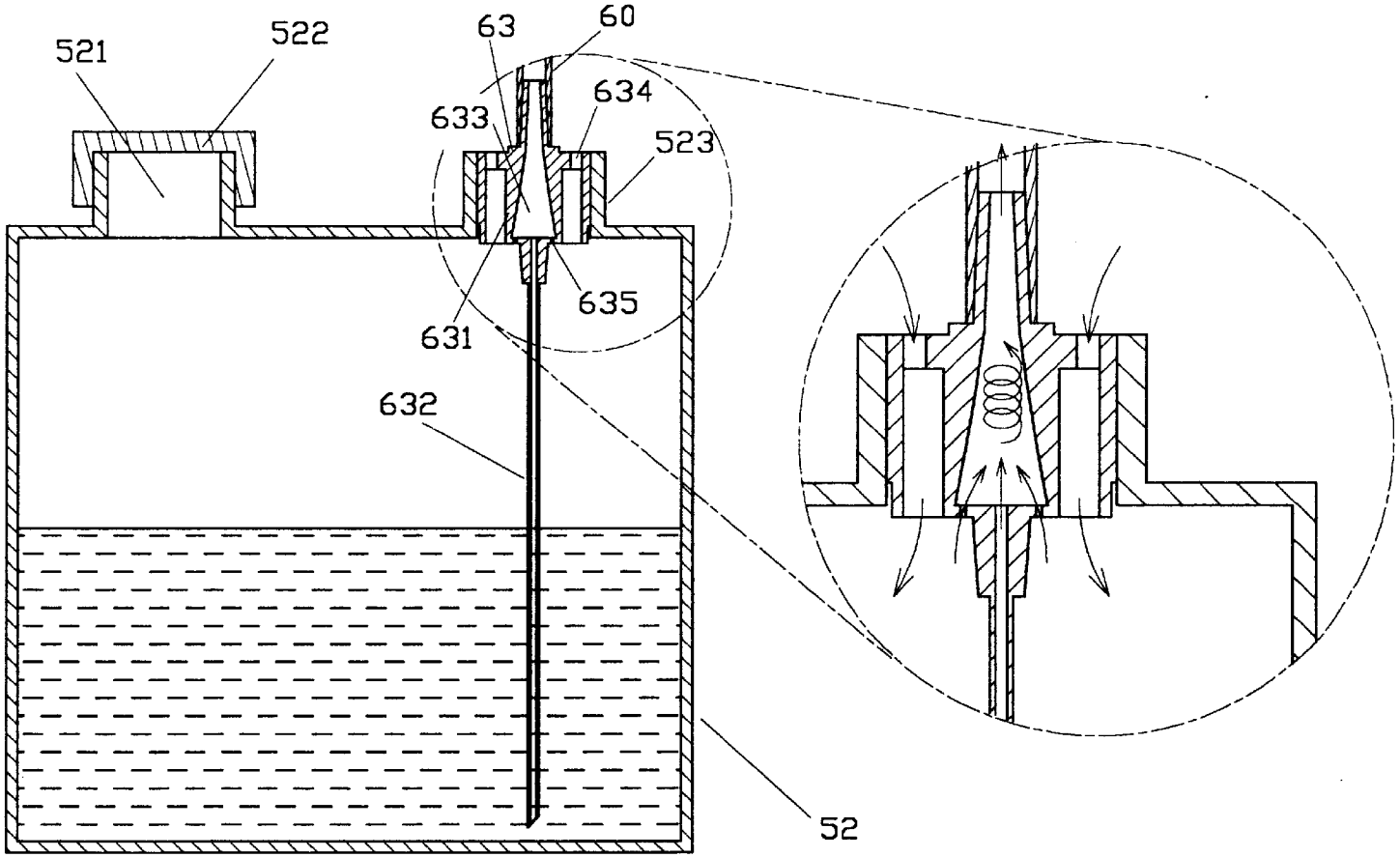
FIG. 6 is the structure of another preferred embodiment and the operation thereof in accordance with the present invention.

FIG. 6 is the structure of another preferred embodiment and the operation thereof in accordance with the present invention. As shown in the figure, the top side of the container 52 is provided with an inlet 521 and an opening 523, wherein the inlet 521 allows a cleaning solution to be fed and on the top of the inlet 521, a cap 522 is provided for the covering of the inlet 521. The interior of the opening 523 is plugged with a plug 63 having an expansion section 631 at the center thereof. The bottom of the expansion section 631 is a suction tube 632 extended to the cleaning solution contained in the container 52. The top of the expansion section 631 is connected to the guiding tube 60 to a three port connection head 87. The plug 63, at the external circumferential edge of the expansion section 631, is provided with a plurality of holes 634 so as to communicate with the interior and external sides of the container 52. The internal of the expansion section 631 is provided with a tapered-shaped turbulent chamber 633, and the bottom section of the turbulent chamber 633 is provided with a plurality of pressurizing holes 635 which are in communication with the interior of the container 52. In operation, when the internal combustion engine 70 is activated, the turbulent chamber 623 becomes vacuum via the guiding tube 60 such that the cleaning solution of the container 52 can be sucked to the turbulent chamber 633. At this instance, the pressure of the container 52, which lost, will be compensated by the external air via the communication hole 634 to the container 52. The turbulent chamber 633 employs vacuum to suck the cleaning solution and at the same time air enters the turbulent chamber 633 via the pressurizing hole 635. By means of the tapered nozzle of the turbulent chamber 633, the air and the cleaning solution are mixed thoroughly to produce appropriate bubbles to enter the internal combustion engine via the guiding tube 60, three-port connection head 87, and the air-inlet tube 80 so as to produce a cleaning effectiveness to the internal combustion engine.

In accordance with the present invention, the advantages of the present invention are as follows:

(1) Convenient in Operation

The user needs a container 50 to contain a cleaning solution and a guiding tube 60 is then inserted into the container 50. Another end of the guiding tube 60 is then inserted into the container 50. Due to the vacuum produced by ignition of the internal combustion engine, the cleaning solution in the container 50 is sucked to cleaning away the accumulated carbon.

(2) The Cleaning Device is Portable

As only a container 50 and a guiding tube 60 with a pressuring hole 62 are required, the device has a small size and is portable.

(3) Low Cost of Treating Process

The device of the present invention is simple and the cleaning process does not require other supplementary equipment. Thus the cost of cleaning is very low.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A portable-type cleaning device for an internal combustion engine comprising a container containing a cleaning solution and a guiding tube connected to the container and the internal combustion engine, and an opening being provided at a top end of the container, wherein the external diameter of the guiding tube is smaller than the internal diameter of the opening of the container, and the middle section of the guiding tube is provided with a pressurizing hole for entry of air, the height of the pressurizing hole is at least higher than that of the level of the cleaning solution within the container.

2. The portable-type-cleaning device for an internal combustion engine of claim 1, wherein a partitioning disc having a pore is mounted at the opening of the container and for the positioning of the guiding tube.

3. The portable-type cleaning device for an internal combustion engine of claim 1 wherein the middle section of the guiding tube is formed into an air-mixing chamber having a large space, and the pressurizing hole is positioned at the circumferential edge of the air-mixing hole to prolong mixing time of air and the cleaning solution.

4. The portable-type cleaning device for an internal combustion engine of claim 1, wherein a foamed body is provided within an air-mixing chamber to increase the amount and size uniformity of the bubbles formation.

5. The portable-type cleaning device for an internal combustion engine of claim 1, wherein the lower section of the air-mixing chamber is provided with an anti-reverse flow valve, having an external diameter larger than the internal diameter of the guiding tube, for sealing.

6. The portable-type-cleaning device for internal combustion engine of claim 1, wherein one end of the guiding tube inserted into the container has a sloping port, facilitating smooth flow of the cleaning solution.

7. A portable-type cleaning device for an internal combustion engine comprising a container containing a cleaning solution and a guiding tube connected to the container and the internal combustion engine, and an opening being provided at a top end of the container, wherein interior of the opening is plugged with a plug having an expansion section at the center thereof, and the bottom of the expansion section is a suction tube extended to the container, and the top of the expansion section is connected to the guiding tube, and the plug, at the external circumferential edge of the expansion section, is provided with a plurality of communication holes so as to communicate with the interior and external sides of the container, and the internal of the expansion section is provided with a plurality of pressurizing holes which are in communication with the interior of the container.

8. The portable-type cleaning device for an internal combustion engine of claim 7, wherein the expansion section is provided with tapered-shaped turbulent chamber therein, thereby sucked cleaning agent and pressurized air were thoroughly mixed to appropriately produce bubbles.

* * * * *